US007805946B2

(12) United States Patent
Ohri et al.

(10) Patent No.: US 7,805,946 B2
(45) Date of Patent: Oct. 5, 2010

(54) COMBUSTOR FLOW SLEEVE ATTACHMENT SYSTEM

(75) Inventors: Rajeev Ohri, Winter Springs, FL (US); Arthur J. Harris, Jr., Orlando, FL (US); Elliot G. Griffin, Winter Springs, FL (US); Michael H. Koenig, Oviedo, FL (US); Herbert C. Reid, Orlando, FL (US); Paul D. Maples, Celebration, FL (US)

(73) Assignee: Siemens Energy, Inc., Orlando, FL (US)

( * ) Notice: Subject to any disclaimer, the term of this patent is extended or adjusted under 35 U.S.C. 154(b) by 839 days.

(21) Appl. No.: 11/298,323

(22) Filed: Dec. 8, 2005

(65) Prior Publication Data

US 2007/0130958 A1 Jun. 14, 2007

(51) Int. Cl.
*F02C 1/00* (2006.01)
*F02G 3/00* (2006.01)

(52) U.S. Cl. ..... 60/760; 60/796

(58) Field of Classification Search ..... 60/752–760, 60/796

See application file for complete search history.

(56) References Cited

U.S. PATENT DOCUMENTS

| | | | | |
|---|---|---|---|---|
| 2,715,816 | A * | 8/1955 | Thorn et al. | 60/758 |
| 4,438,956 | A * | 3/1984 | Jones et al. | 285/223 |
| 4,903,476 | A | 2/1990 | Steber et al. | |
| 5,259,184 | A | 11/1993 | Borkowicz et al. | |
| 5,274,991 | A | 1/1994 | Fitts | |
| 5,309,710 | A | 5/1994 | Corr | |
| 5,323,600 | A | 6/1994 | Munshi | |
| 5,685,139 | A * | 11/1997 | Mick et al. | 60/776 |
| 6,216,442 | B1 | 4/2001 | Belsom et al. | |
| 6,331,110 | B1 | 12/2001 | Steber et al. | |
| 6,341,485 | B1 * | 1/2002 | Liebe | 60/772 |
| 6,354,071 | B2 | 3/2002 | Tegel et al. | |
| 6,374,594 | B1 | 4/2002 | Kraft et al. | |
| 6,414,458 | B1 | 7/2002 | Hatley et al. | |
| 6,438,959 | B1 | 8/2002 | Dean et al. | |
| 6,526,756 | B2 | 3/2003 | Johnson et al. | |
| 6,735,949 | B1 | 5/2004 | Haynes et al. | |
| 6,823,676 | B2 * | 11/2004 | Conete et al. | 60/796 |
| 7,237,388 | B2 * | 7/2007 | Aumont et al. | 60/796 |
| 2002/0108375 | A1 * | 8/2002 | Johnson et al. | 60/772 |
| 2003/0123953 | A1 * | 7/2003 | Razzell | 411/419 |
| 2004/0032089 | A1 * | 2/2004 | Conete et al. | 277/369 |

FOREIGN PATENT DOCUMENTS

| | | | |
|---|---|---|---|
| JP | 63029118 | A | 6/1988 |

* cited by examiner

*Primary Examiner*—Michael Cuff
*Assistant Examiner*—Andrew Nguyen

(57) ABSTRACT

Embodiments of the invention relate to a combustor flow sleeve for a turbine engine. According to aspects of the invention, the flow sleeve can be attached to one of the components in the combustor head-end by a plurality of fasteners. In one embodiment, the flow sleeve can be attached directly to the combustor head-end component by a plurality of bolts. The bolted flow sleeve can reduce the time to install or remove the flow sleeve. In certain areas, it may not be possible to directly attach the flow sleeve to the combustor component. A flow sleeve according to aspects of the invention can be adapted to facilitate indirect attachment to the combustor head-end component. The flow sleeve can further be adapted to include thermal relief slots to accommodate any differential thermal expansion or contraction between the flow sleeve and the component to which the flow sleeve is attached.

17 Claims, 8 Drawing Sheets

COMBUSTOR FLOW SLEEVE ATTACHMENT SYSTEM

FIELD OF THE INVENTION

The invention relates in general to turbines engines and, more specifically, to combustor flow sleeves for turbine engines.

BACKGROUND OF THE INVENTION

FIG. 1 shows a portion of one known combustor system 10 of a turbine engine. The combustor 10 includes a combustor head-end 12, a transition duct 14, and a liner 16 extending therebetween. The term "combustor head-end" generally refers to the fuel injection/fuel-air premixing portion of the combustor 10. The liner 16 extends away from the combustor head-end 12 toward the transition duct 14. The liner 16 can connect between the combustor head-end 12 and the transition 14 in any of a number of known ways.

During engine operation, the liner 16 requires cooling because the high temperature of the combustion occurring inside of the liner 16 can threaten the structural integrity of the liner 16. One known scheme for air-cooling at least a portion of the liner 16 involves the use of a flow sleeve 18. The flow sleeve 18 surrounds a portion of the liner 16, so that an annular passage 20 is formed therebetween. Air 22 from the compressor section (not shown) can enter the combustor head-end 12 through the annular passage 20. As it travels through the passage 20, the air 22 is directed along the outer peripheral surface 24 of the liner 16 so as to cool the liner 16. In addition to cooling, the flow sleeve 18 can help to make the air flow through the combustor head-end 12 more uniform, resulting in better mixing with fuel, which in turn can reduce the formation of undesired emissions during combustion and can help to maintain more uniform temperature at the exit end of the liner 16.

The flow sleeve 18 is attached at one end 26 to one or more of the components in the head-end 12 of the combustor 10, such as the combustor casing 28. In one known system, the flow sleeve 18 is welded to one of the combustor head-end components. In another known system, the flow sleeve 18 is sandwiched or otherwise clamped between two or more components in the combustor head-end 12.

Experience has revealed a number of drawbacks with these attachment systems. For instance, they can introduce new fluid leak paths between the combustor head-end 12 and the flow sleeve 18. Fluid leakage can diminish engine efficiency and can have an adverse impact on engine emissions. Thus, complicated sealing systems must be devised. Moreover, the sandwiched flow sleeve attachment system usually involves high stack-up tolerances and interference issues because the flow sleeve 18 is directly engaging two or more components in the combustor head-end 12.

Further, the flow sleeve 18 and the components in the combustor head-end 12 to which the flow sleeve 18 is attached can undergo different rates of thermal expansion and contraction. As a result, high thermal stresses can be imposed on the area of attachment, which can lead to low cycle fatigue failures. In the case of a welded flow sleeve, such a failure can manifest as weld cracks.

Depending on the severity of the damage, the flow sleeve 18 may need to be replaced. Further, repair may be needed on other combustor components in the combustor section. In order to access any of these components for repair or replacement, the flow sleeve 18 must be removed. Removal of a flow sleeve that is welded or sandwiched between other head-end components is difficult, labor intensive and time consuming, and can result in extended outages. Likewise, upon completion of the repairs, the installation of the flow sleeve 18 and reassembly of the combustor head-end 12 is also a time consuming and difficult task. Detailed procedures must be developed to guide field technicians through the assembly and disassembly process. In light of the above, it will be appreciated that such attachment systems can significantly increase life cycle costs over the life of an engine.

In addition, some combustors may be located in an area in which a flow sleeve cannot be directly connected to the combustor head-end used because of interferences. One location in which interference concerns can arise is at or near an interface 30 between an upper combustor casing 32 and a lower combustor casing 34, a portion of which is shown in FIG. 2. The upper and lower casings 32, 34 can cooperate to enclose the combustor section 10 of the engine. The upper and lower casings 32, 34 abut along a plane that is substantially horizontal and is sometimes referred to as the horizontal joint 36. In one known engine design, a flow sleeve cannot be connected to the head-end 12 of a combustor system 10 located at or near the horizontal joint 36 because of an interference with large joint bolts 38 that connect the casing halves 32, 34. The joint bolts 38 protrude from the interface 30 and can be retained by a nut 40.

The welded and sandwiched flow sleeve attachment systems can also preclude or detract from the use of other desirable combustion components, such as certain pre-mix fuel rings. As a result, less efficient or less desirable systems may need to be employed to avoid potential interferences with the flow sleeve 18.

Thus, there is a need for a flow sleeve attachment system that can minimize such concerns.

SUMMARY OF THE INVENTION

Aspects of the invention are directed to a turbine engine combustor system. The system includes a combustor component and a flow sleeve. The flow sleeve has an axial upstream end and an axial downstream end. The flow sleeve can have an associated longitudinal axis. In one embodiment, the flow sleeve can include a plurality of thermal relief slots extending along the flow sleeve from the axial downstream end.

The downstream end of the flow sleeve is connected to the combustor component by a plurality of fasteners, which can be bolts. In one embodiment, there are at least four fasteners. The fasteners can extend substantially radially to the longitudinal axis of the flow sleeve. In one embodiment, the flow sleeve and the combustor component can be indirectly connected in at least one location. In one such location, a spacer can be disposed between and operatively engage the flow sleeve and the combustor component. One of the fasteners can extend through the spacer. The fastener that extends through the spacer can be non-radial to the longitudinal axis of the flow sleeve.

Aspects of the invention are also directed to a second turbine engine combustor system. The system includes a combustor component and a flow sleeve. The flow sleeve has an axial upstream end, an axial downstream end, and an inner passage. The flow sleeve can have a longitudinal axis.

The flow sleeve includes one or more thermal relief slots. Each slot extends from the axial downstream end and toward the axial upstream end of the flow sleeve. In one embodiment, the thermal relief slots can extend no more than about half the axial length of the flow sleeve.

The downstream end of the flow sleeve is connected to the combustor component. The downstream end of the flow sleeve can be connected to the combustor component by a plurality of fasteners. The fasteners can be, for example, bolts. The fasteners can extend substantially radially to the longitudinal axis.

The flow sleeve and the combustor component can be indirectly connected in one or more locations. In such locations, the system can include a spacer that extends between and operatively engages the flow sleeve and the combustor component. One of the fasteners can extend through the spacer, and such fastener can be non-radial to the longitudinal axis of the flow sleeve.

A third turbine engine combustor system according to aspects of the invention includes a first combustor component and a flow sleeve. The first combustor component has a plurality of passages therein. The flow sleeve has an axial upstream end, an axial downstream end, and an inner passage. The flow sleeve includes at least one thermal relief slot. The thermal relief slot extends from the axial downstream end in the direction of the axial upstream end. The flow sleeve can have a longitudinal axis.

A plurality of fasteners connect the downstream end of the flow sleeve to the first combustor component. The flow sleeve includes a plurality of passages proximate the downstream end. The passages in the flow sleeve are substantially aligned with the passages in the first combustor component. Each of the fasteners extends through a respective one of the passages in the flow sleeve and into engagement with an aligned passage in the first combustor component. The fasteners can extend substantially radially to the longitudinal axis.

In one embodiment, one or more of the passages in the flow sleeve can be offset at least radially inwardly from the other passages. The flow sleeve and the first combustor component can be indirectly connected at the at least one offset passage in the flow sleeve. In such case, the system can include a second combustor component that operatively engages the first combustor component. The second combustor component can be, for example, a joint bolt. The system can further include a spacer that extends between and operatively engages the flow sleeve at and/or proximate the offset passage and the second combustor component. A respective one of the fasteners extends through the spacer and into engagement with the second combustor component. The fastener that extends through the spacer can be non-radial to the longitudinal axis.

DETAILED DESCRIPTION OF EMBODIMENTS OF THE INVENTION

Embodiments of the present invention are directed to a flow sleeve attachment system that can minimize the problems associated with known systems for attaching a flow sleeve to the combustor head-end. According to embodiments of the invention, a combustor flow sleeve can be detachably connected to the combustor head-end by a plurality of fasteners. Further, the flow sleeve can be adapted to accommodate differential rates of thermal expansion of the flow sleeve and the combustor head-end. Embodiments of the invention will be explained in the context of one possible system, but the detailed description is intended only as exemplary. Embodiments of the invention are shown in FIGS. 3-8, but the present invention is not limited to the illustrated structure or application.

Figure 1:
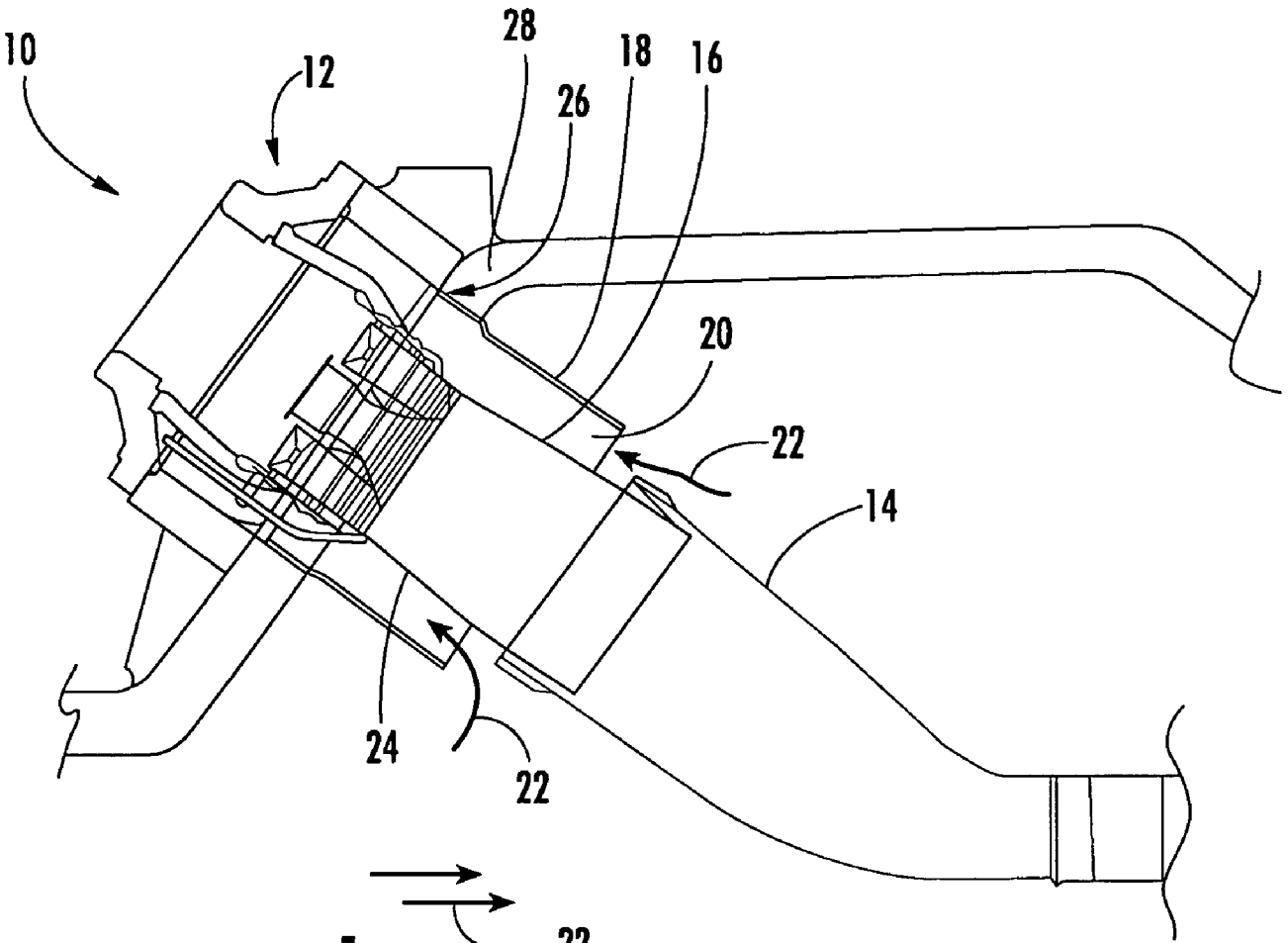
FIG. 1 (PRIOR ART)
FIG. 1 is a partial cross-sectional view of a portion of the combustor section of a turbine engine having a flow sleeve attached to the combustor head-end in a known manner.
Figure 2:
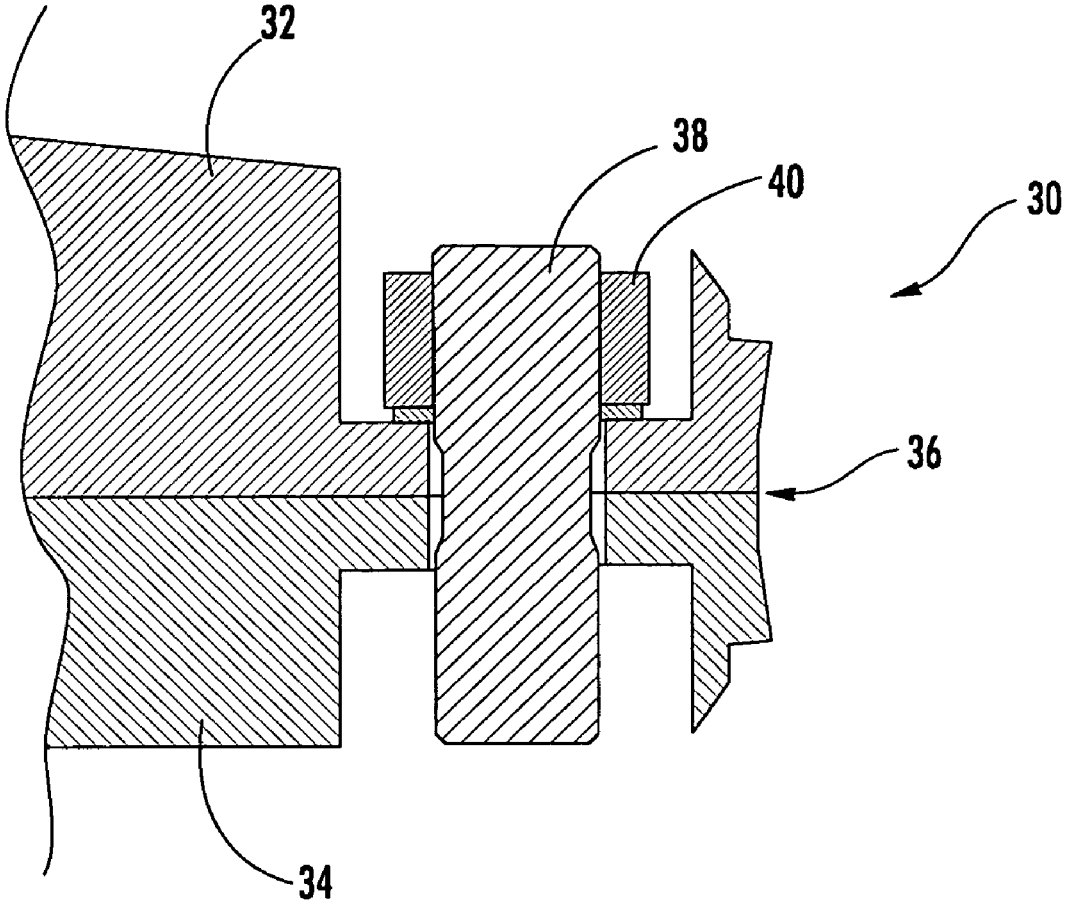
FIG. 2 (PRIOR ART)
FIG. 2 is a cross-sectional view of a known interface between an upper and a lower combustor casing connected by a joint bolt.
Figure 3:
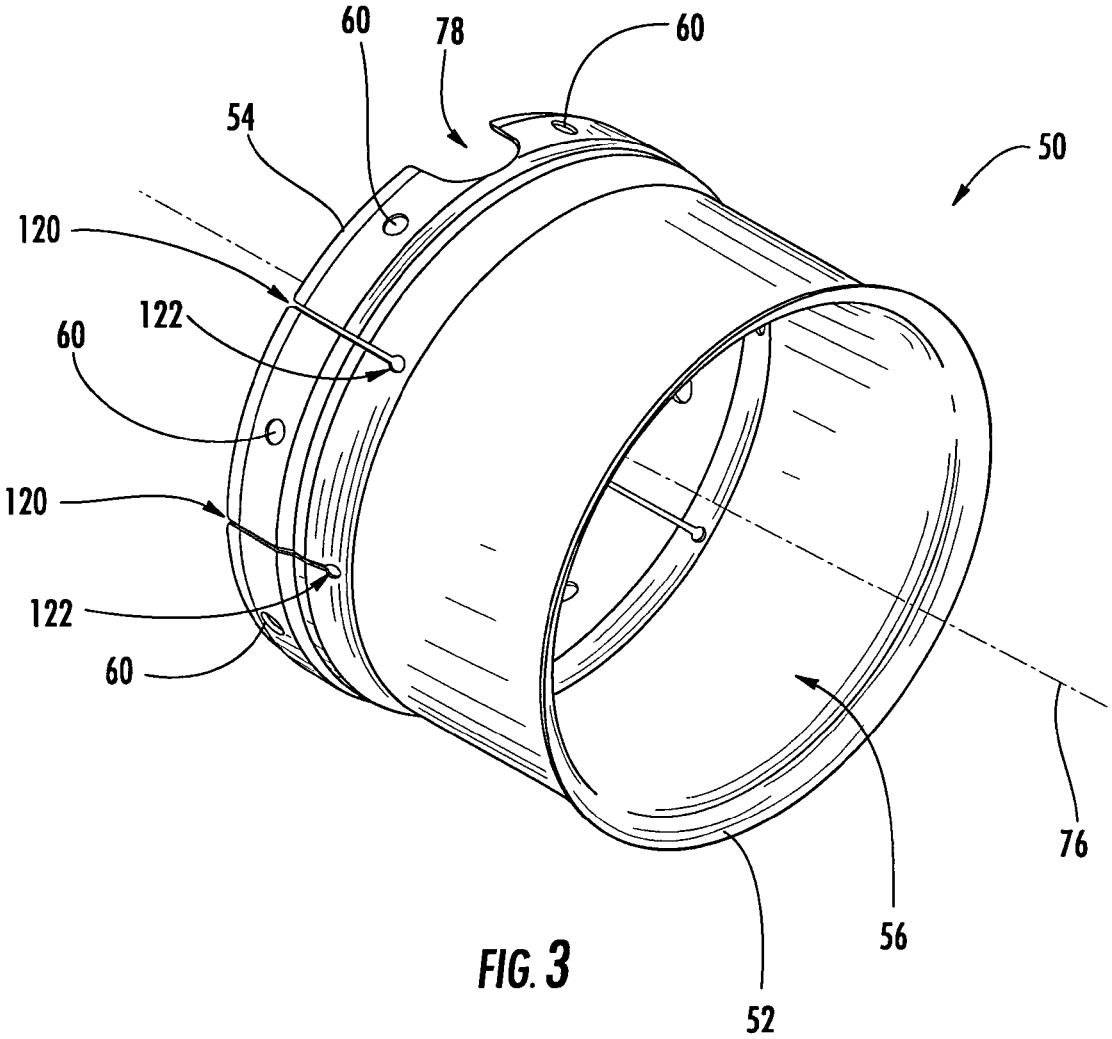
FIG. 3 is an isometric view of a flow sleeve according to aspects of the invention.

Flow sleeves are known, and embodiments of the invention are not limited to any specific flow sleeve. One example of a flow sleeve 50 according to aspects of the invention is shown in FIG. 3. The flow sleeve 50 can be generally tubular having an axial upstream end 52, an axial downstream end 54 and an inner passage 56. The terms "upstream" and "downstream" are used to refer to the ends of the flow sleeve 50 relative to the direction of airflow through the flow sleeve 50. The flow sleeve 50 can be substantially straight, or it can include one or more tapers, flares, curves or bends. The length, thickness and the mass of the flow sleeve can be optimized to raise the natural frequency of the flow sleeve beyond known combustor section frequencies to avoid any vibration issues. The flow sleeve 50 can be a single piece, or it can be made from a plurality of pieces or segments. The inner passage 56 of the flow sleeve 50 can be substantially circular, but other conformations are possible. The flow sleeve can be made of any suitable material including, for example, HAST-X.

Figure 4:
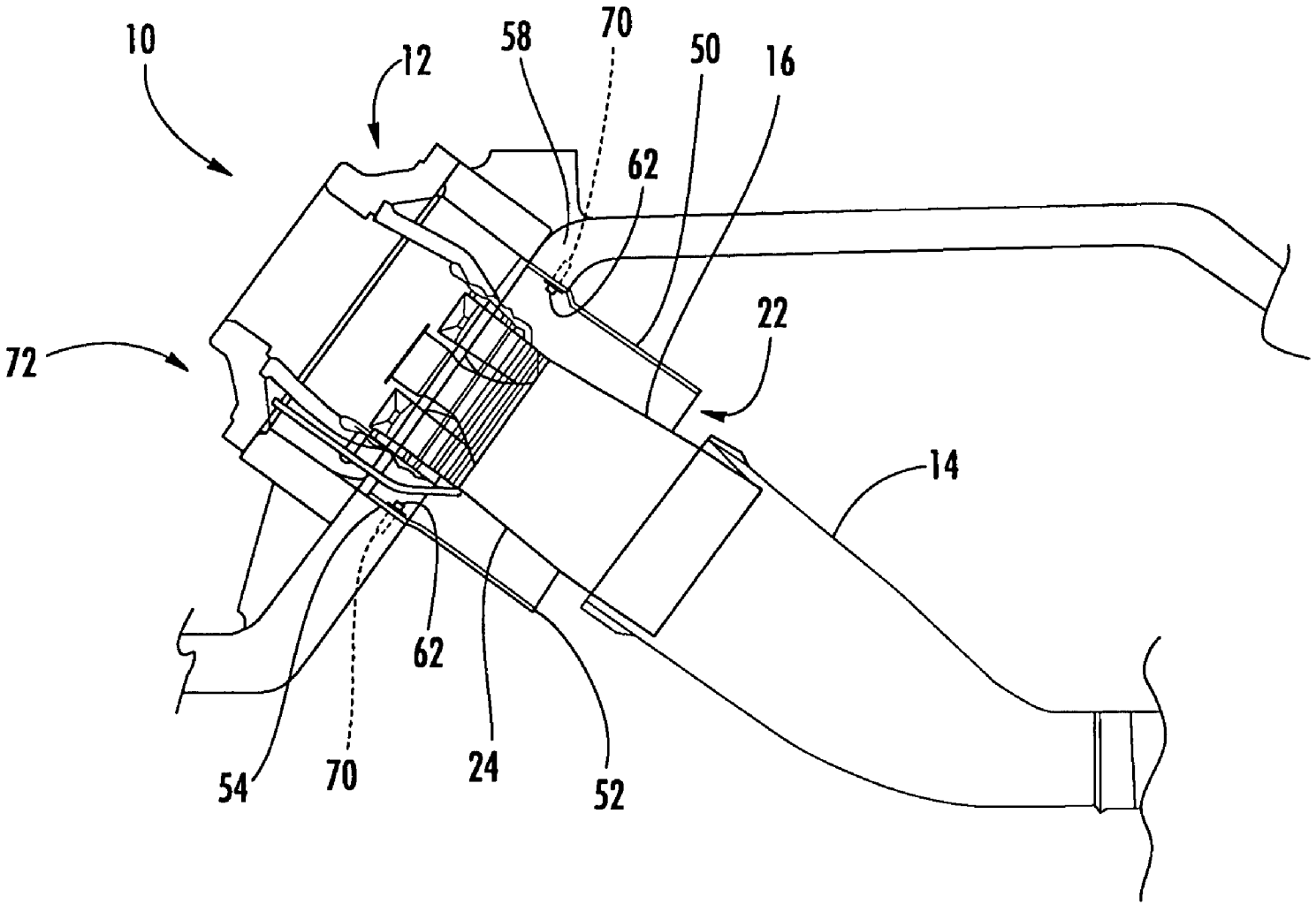
FIG. 4 is a partial cross-sectional view of a portion of the combustor section of a turbine engine having a flow sleeve attached to the combustor head-end by a plurality of fasteners in accordance with aspects of the invention.

Referring to FIG. 4, the downstream end 54 of the flow sleeve 50 can be attached to one or more of the components in the combustor head-end 12. The flow sleeve 50 can extend cantilevered therefrom to the upstream end 52. The specific components and geometry in the area of the head-end 12 can vary from combustor to combustor, and embodiments of the invention are not intended to be limited to any specific head-end combustor system nor to any specific components in the head-end 12. The flow sleeve 50 can be attached to any suitable component in the combustor head-end 12 including, for example, the combustor casing 58 in that region.

According to aspects of the invention, the flow sleeve 50 can be connected to one of the combustor head-end components by a plurality of fasteners. Accordingly, the downstream end 54 of the flow sleeve 50 can be adapted as needed to facilitate such attachment. For instance, a plurality of passages 60 can be formed in the wall of the flow sleeve 50, as shown in FIG. 3. Thus, one of the fasteners can extend through a respective one of the passages 60 and into engagement with the combustor head-end component. There can be any quantity of fasteners. In one embodiment, at least eight fasteners can be used to connect the flow sleeve 50 to the combustor head-end component. In another embodiment, at least four fasteners can be used to connect the flow sleeve 50 to the combustor head-end component. The fasteners can be made of any suitable material and can be sized as needed.

The plurality of fasteners can all be substantially identical. Alternatively, at least one of the fasteners can be different from the other fasteners in one or more respects. The fasteners can be arranged in various ways. For example, the fasteners can be substantially equally spaced about the flow sleeve 50. Alternatively, the fasteners can be provided at regular or irregular intervals, as may be necessary or desired. The fasteners can be substantially axially aligned on the flow sleeve 50, or at least one of the fasteners can be axially offset from the other fasteners.

Figure 5:
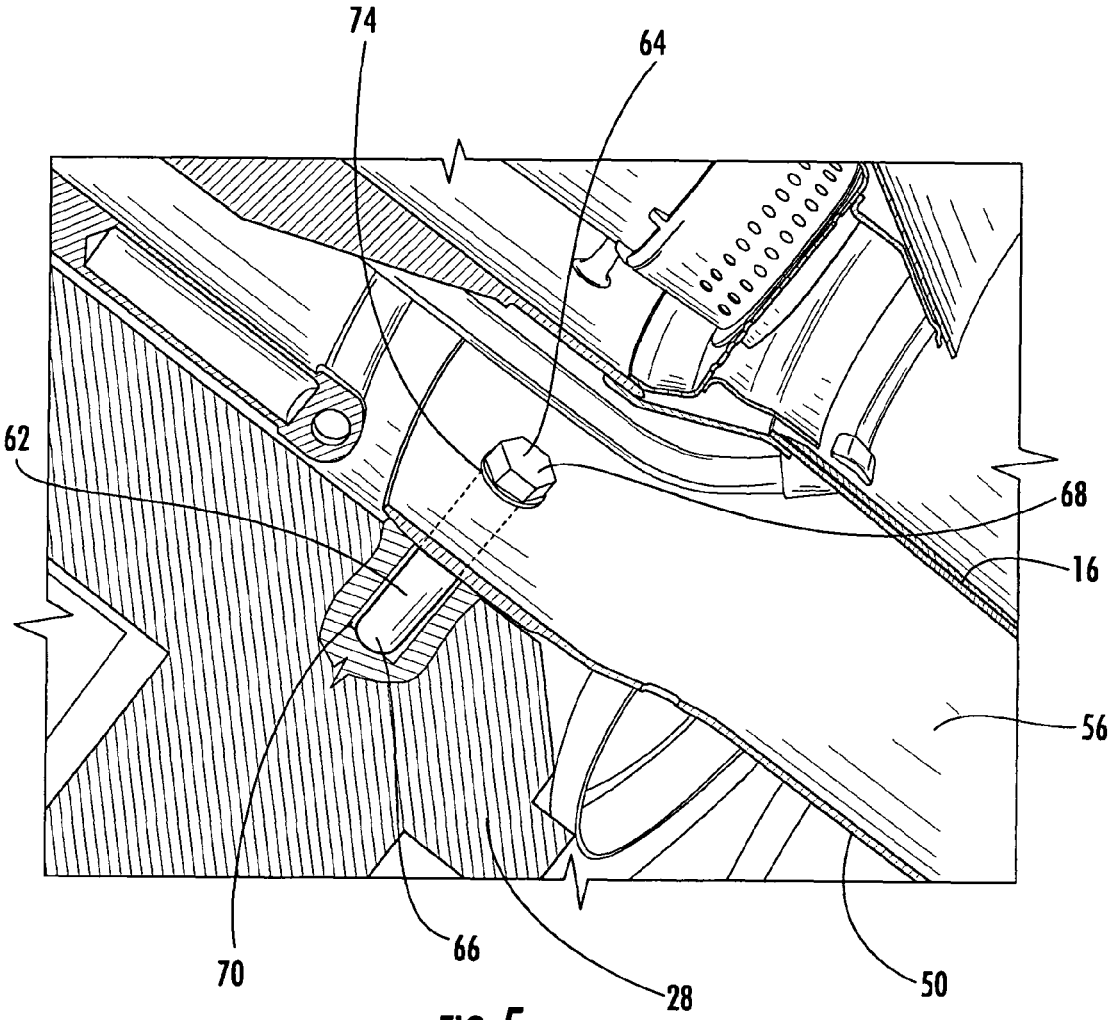
FIG. 5 is a close-up isometric view of a flow sleeve attachment system according to aspects of the invention, showing the flow sleeve attached to the combustor head-end by a plurality of bolts (only one of which is shown).

In one embodiment, the fasteners can be bolts 62, as shown in FIGS. 4 and 5. Each bolt 62 can have a first end 64 and a second end 66. The first end 64 can include a head 68. At least a portion of each bolt 62 can be threaded. For every bolt 62, a passage 70 can be provided in the combustor head-end component to which the flow sleeve 18 is being attached. Each passage 70 can be configured to receive at least a portion of one of the bolts 62. Preferably, the bolts 62 retainably engage the passage 70. In one embodiment, the passages 70 can include threads for threaded engagement with the bolts 62.

During installation or removal, the flow sleeve 50 can be inserted through an entrance 72 in the combustor casing 58, which may require the removal of some of the combustor head-end components. When the passages 60 in the flow sleeve 50 and the passages 70 in the combustor head-end component are substantially aligned, the bolts 62 can be passed through the passages 60 and into engagement with the passages 70 in the combustor head-end component, as shown in FIG. 5. The head 68 of each bolt 62 can bear against the inner passage 56 of the flow sleeve 50. A washer 74 can be disposed between the bolt head 68 and the inner passage 56. In one embodiment, the bolts 62 can extend substantially radially in their installed position. The term "radially" and variations thereof is intended to mean relative to the longitudinal axis 76 (see FIG. 3) of the flow sleeve 50, which may be straight or non-straight. It will be appreciated that the bolted flow sleeve according to aspects of the invention can simplify and expedite the installation and the removal of the flow sleeve 50 at least in comparison to previous flow sleeve attachment systems.

However, as noted in the Background, there may be some locations in the combustor section that may not permit a flow sleeve to be directly connected to the combustor head-end in the manner described above. Aspects of the invention can facilitate the attachment of a flow sleeve to the combustor head-end in such locations without the need for relocating or without substantially redesigning the existing components. To that end, the attachment system according to aspects of the invention can include indirect attachment of a flow sleeve to the combustor head-end. By way of example, the following discussion will be directed to a flow sleeve and an associated attachment system adapted for combustors that are located at or near the horizontal joint. It will be understood that aspects of the invention are not limited to the particular system shown.

Figure 6:
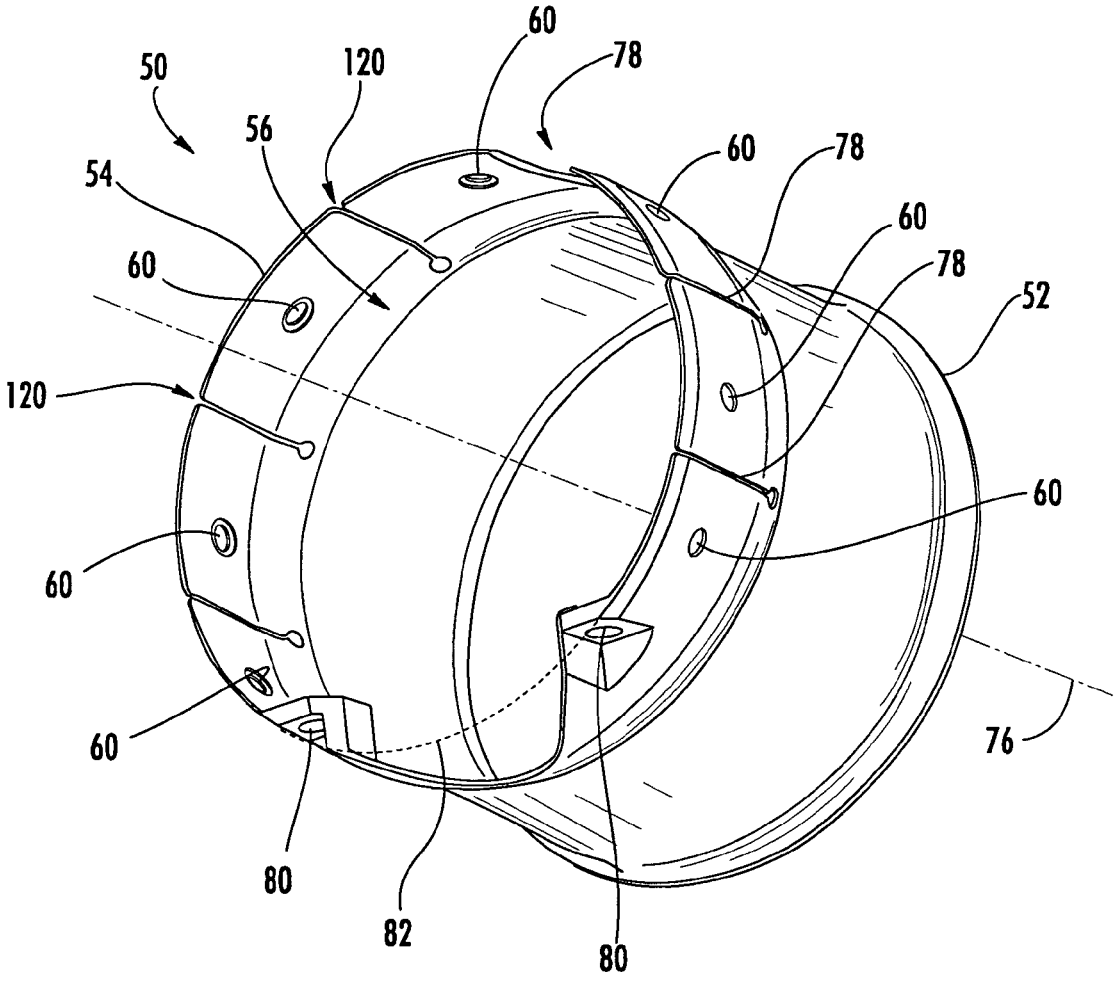
FIG. 6 is an isometric view of an alternative flow sleeve according to aspects of the invention, wherein the flow sleeve is adapted to avoid potential interferences with components in the combustor section.

The flow sleeve 50 can include local features at a region near and including its downstream end 54, as shown in FIG. 6. For instance, one or more cutouts 78 can be provided in the flow sleeve 50. These cutouts 78 can be sized, shaped and located to avoid possible interferences with other components in the intended area.

Alternatively or in addition to the cutouts 78, one or more passages 80 in the flow sleeve 50 can be configured to permit indirect attachment to a combustor head-end component, as may be necessary in certain locations. For purposes of facilitating discussion herein, such passages 80 will be referred to as the "offset passages." Ideally, the offset passages 80 are used only where needed to avoid interferences; the remainder of the passages 60 in the flow sleeve 50 can be configured to receive radially extending fasteners, as described above.

The offset passages 80 can be substantially identical to the size and shape of the other passages 60 in the flow sleeve 50, but they can differ in these respects as well. However, the offset passages 80 can differ in their position and/or orientation relative to the other passages 60 in the flow sleeve. For example, one or more of the offset passages 80 may not extend radially relative to the longitudinal axis 76 of the flow sleeve 50. In one embodiment, the axis of at least one of the offset passages 80 can be oriented substantially perpendicular to the horizontal joint 36.

Further, it will be appreciated that, by providing the offset passages 80, the downstream end 54 of the flow sleeve 50 may no longer be substantially circular. In one embodiment, the offset passages 80 can be described as being offset from the locus of an imaginary circle 82 defined by a portion of the downstream end 54 of the flow sleeve 50, excluding regions at and near the offset passages 80. For example, one or more of the offset passages 80 can be positioned radially inward from the locus of the imaginary circle 82. Alternatively, one or more of the offset passages 80 can be positioned radially inward from the locus of the imaginary circle 82.

Figure 7:
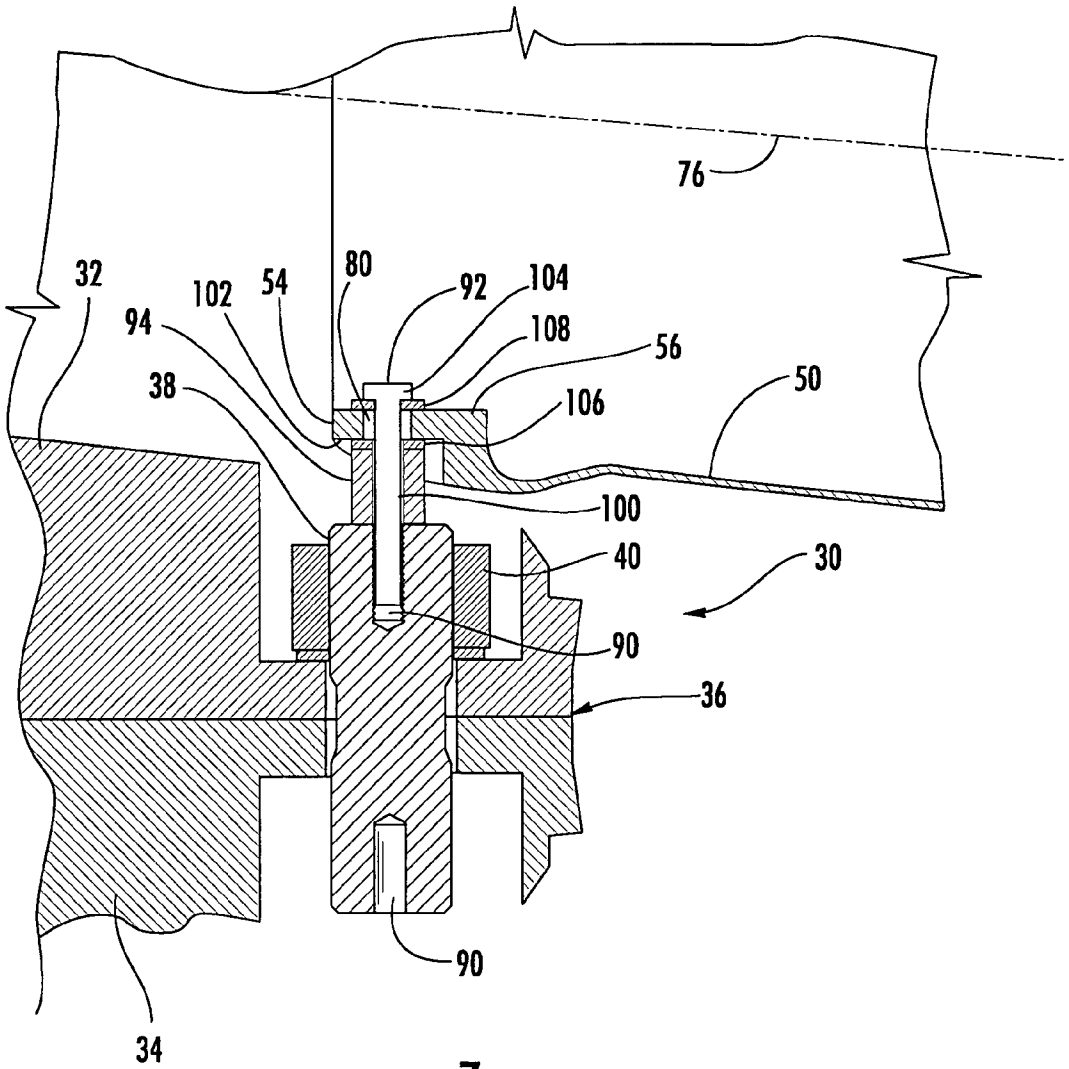
FIG. 7 is a cross-sectional view of one of the attachment points between the flow sleeve of FIG. 5 and the combustor casing according to aspects of the invention

FIG. 7 shows one embodiment of a system for attaching the flow sleeve 50 by one of its offset passages 80 at a location that is near the horizontal joint 36 between the upper and lower combustor casings 32, 34. As is known, each of the combustor casings 32, 34 includes a plurality of openings (not shown) to receive a portion of the flow sleeve. The openings can be arrayed in an annular pattern. However, for those openings at or near the horizontal joint 36, the geometry of the opening and/or the general area can present challenges for mounting and dismounting a flow sleeve. If a flow sleeve 50 like the one shown in FIG. 3 were used at such location, the passages 60, which receive a fastener radially to the longitudinal axis 76 of the flow sleeve 50, would not align with the longitudinal axis of the joint bolt 38 because the joint bolt 38 is not perpendicular to the axis 76 of the flow sleeve 50, as is apparent in FIG. 7.

In one engine design, there are four flow sleeves that cannot be connected to the combustor component by radially extending fasteners in at least one location about each of the four flow sleeves. For example, on one side of the combustor casing, there are two flow sleeves proximate the horizontal joint 36—one received in an opening in the upper casing 32 proximate the horizontal joint 36 and the other received in an opening in the lower casing 34 proximate the horizontal joint 36—that include at least one offset passage. There are two flow sleeves on the opposite side of the combustor casing that are arranged in a similar manner.

By offsetting one or more of the passages 80, as described above, the passage 80 can be oriented substantially perpendicular to the joint bolt 38 to thereby allow the fastener to be in alignment with the joint bolt 38. According to aspects of the invention, the joint bolt 38 can be adapted to receive a fastener. That is, a passage 90 can be provided in at least one end of the joint bolt 38. The passage 90 can extend substantially along the longitudinal axis of the joint bolt 38. The passage 90 can receive a portion of a fastener. In one embodiment, the fastener can be a bolt 92, which may or may not be identical to the bolts 62 used to attach the flow sleeve 50 directly to the combustor head-end component. The passages 90 can be configured to engage the bolt 92 in various ways including, for example, by threaded engagement. According to aspects of the invention, the addition of the passage 90 in the joint bolt 38 may be the only required modification to the existing horizontal interface 30. Ideally, there are no changes to the upper and lower casings 32, 34.

Figure 8:
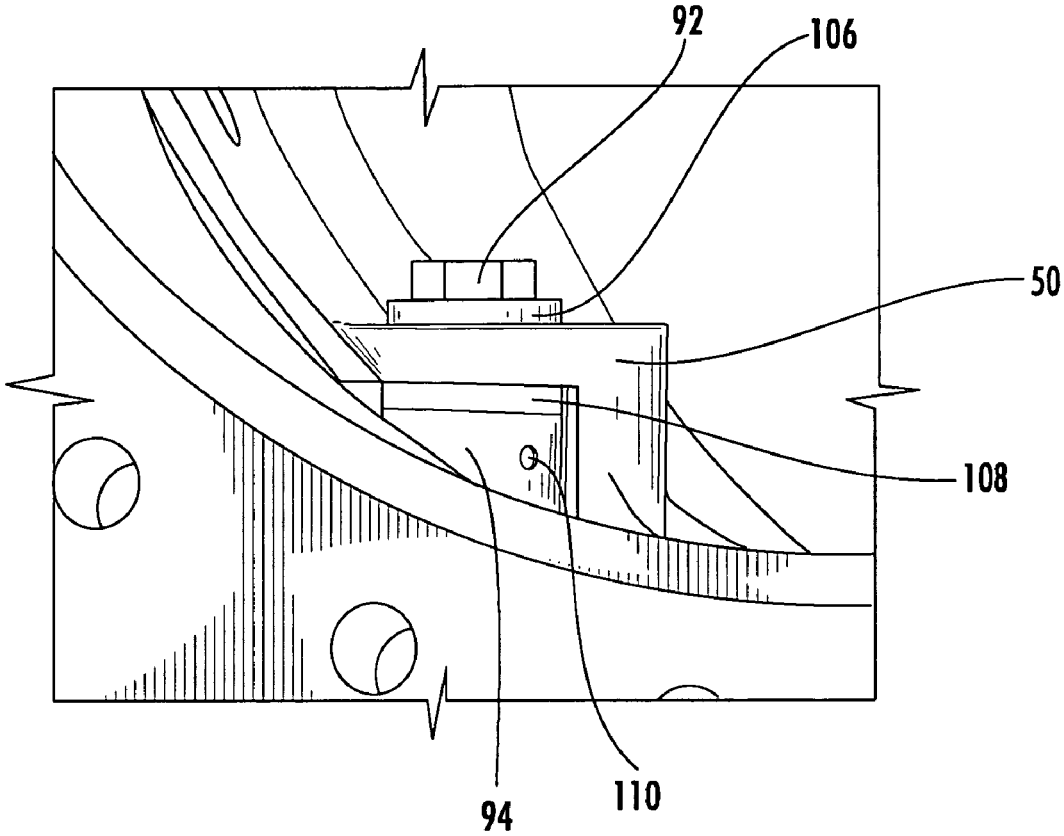
FIG. 8 is a close-up isometric view of one of the attachment points between the flow sleeve of FIG. 5 and the combustor casing according to aspects of the invention.

A spacer 94 can be interposed between the flow sleeve 50 and the joint bolt 38. The spacer 94 can have a passage 100 extending therethrough to receive a fastener. The spacer 94 can extend from the end of the joint bolt 38 and into engagement with the outer peripheral surface 102 of the flow sleeve 50. In one embodiment, a washer 106 can be disposed between the flow sleeve 50 and the spacer 94. The bolt 92 can be passed through the passage 100 in the spacer 94 and into engagement with the passage 90 in the joint bolt 38. The head 104 of the bolt 92 can engage the wall of the inner passage 56 of the flow sleeve 50, or a washer 108 can be disposed therebetween. The spacer 94 can be made of any suitable material and can have any suitable conformation. As shown in FIG. 8, the spacer 94 can provide features to facilitate installation. For example, the spacer 94 can provide recesses 110 for engagement by a tool in order to hold the pieces together during installation. When installed, it should be noted that the bolt 92 may extend non-radially relative to the longitudinal axis 76 of the sleeve 50. In one embodiment, the bolt 92 can be substantially perpendicular to the horizontal joint 36. It should be noted that a similar arrangement can be provided on the opposite end of the joint bolt 38 to allow for the attachment of another flow sleeve. As shown in FIG. 7, the joint bolt 38 can have another passage 90 to receive a fastener.

It will be appreciated that these offset passages 80 are used where needed to connect the flow sleeve 50 to the combustor casing 58. In the absence of a need for an indirect connection, the direct connection of the flow sleeve 50 and the combustor head-end 12 is preferred. In one system, the flow sleeve 50 can have seven radially extending passages 60 and two offset passages 80. In one turbine engine having a total of sixteen combustors, the flow sleeves associated with twelve of the combustors can be attached entirely by a plurality of radial fasteners, while the flow sleeves associated with four of the combustors can include one or more offset passages for indirect attachment. Two of these four combustors can bracket the horizontal joint 36 on one side of the combustor, and the other two combustors can bracket the horizontal joint on the other side of the combustor. However, aspects of the invention are not limited to any particular arrangement and all combinations are intended to be included within the scope of the invention.

Regardless of the specific arrangement, it will be appreciated that a flow sleeve attachment system according to aspects of the invention can facilitate assembly/disassembly. Also, the fastener approach can minimize the length of contact between the flow sleeve and the combustor head-end as opposed to the contact length between these components in a welded or a sandwiched attachment system. According to aspects of the invention, it is preferred if the contact length between the flow sleeve and the combustor head-end is kept as small as possible, which in turn can reduce thermal stresses.

The flow sleeve 50 can further be adapted to manage thermal stresses that may develop during engine operation due to any differential thermal response between the flow sleeve 50 and combustor casing 58. To that end, the flow sleeve can include a plurality of thermal relief slots 120, as shown in FIGS. 3 and 6. The thermal relief slots 120 can begin at the downstream end 54 of the flow sleeve 50 and extend therefrom toward the upstream end 52 of the flow sleeve 50. The thermal relief slots 120 can have any suitable configuration. For example, the slots 120 can extend from the downstream end 54 substantially in the direction of the longitudinal axis 76 of the flow sleeve 50. Each slot 120 can have a termination region 122. The termination region 122 can be configured to minimize stress concentrations, such as be providing a rounded end.

The thermal relief slots 120 can be formed by any suitable process including machining. There can be any number of thermal relief slots 120 and the slots 120 can be arranged in various ways on the flow sleeve 50. In one embodiment, there can be a thermal relief slot 120 provided between each neighboring pair of passages 60 or 80 to receive the fasteners. The thermal relief slots 120 can be substantially parallel to each other. The thermal relief slots 120 can all extend substantially the same length from the downstream end 54 of the flow sleeve 50. In one embodiment, the thermal relief slots 120 extend no more than about half the length of the flow sleeve 50. The thermal relief slots 120 can be used in connection with any of the flow sleeve configurations discussed above. Thus, if differential growth between the flow sleeve 50 and the combustor head-end 12 occurs during engine operation, the thermal relief slots 120 can accommodate such differential expansion or contraction, which can reduce life cycle costs as well as repair costs.

The flow sleeve design and its associated attachment system according to aspects of the invention can provide advantages over prior flow sleeves. For instance, they can help in solving multiple issues—providing sufficient backside cooling of the combustor liner, providing more uniform flow through the combustor head-end (which can improve emissions), increasing part life, reducing repair costs, reducing assembly and disassembly time, and minimizing leakage at the flow sleeve-combustor casing, just to name a few possibilities. Further, the flow sleeve according to aspects of the invention is relatively short, easy to handle and light weight. The attachment system according to aspects of the invention does not involve tight tolerances, and there are no stack up tolerance issues compared to existing approaches. As noted earlier, aspects of the invention can expand the range of locations in which a flow sleeve can be used, such as at or near the horizontal joint, with modification of existing structure. Finally, the attachment system according to aspects of the invention can minimize the potential for interference issues and permit the use of other combustor systems that otherwise may not be available due to interferences.

The foregoing description is provided in the context of one possible flow sleeve configuration. Of course, aspects of the invention can be employed with respect to myriad combustors and flow sleeves, including all of those described above. Thus, it will of course be understood that the invention is not limited to the specific details described herein, which are given by way of example only, and that various modifications and alterations are possible within the scope of the invention as defined in the following claims.

What is claimed is:

1. A turbine engine combustor system comprising:

a combustor component;

a substantially tubular flow sleeve having an axial upstream end, an axial downstream end and an outer peripheral surface, the downstream end being substantially tubular without a flange extending radially outwardly from the outer peripheral surface, the downstream end of the flow sleeve being connected to the combustor component by a plurality of fasteners such that the outer peripheral surface of the flow sleeve and the combustor component are in direct contact circumferentially about at least a portion of the outer peripheral surface of the flow sleeve, the flow sleeve extending cantilevered from the combustor component to the upstream end, whereby the upstream end of the flow sleeve is not attached to another structure, the flow sleeve having a longitudinal axis, the fasteners extending substantially radially to the longitudinal axis.

2. The system of claim 1 wherein the fasteners are bolts.

3. The system of claim 1 wherein there are at least four fasteners.

4. The system of claim 1 wherein the flow sleeve includes a plurality of thermal relief slots extending along the flow sleeve from the axial downstream end.

5. The system of claim 1 wherein the flow sleeve and the combustor component are indirectly connected in at least one location, and further including a spacer extending between and operatively engaging the flow sleeve and the combustor component, wherein one of the fasteners extends through the spacer.

6. The system of claim 5 wherein the flow sleeve has a longitudinal axis, and wherein the fastener extending through the spacer is non-radial to the longitudinal axis.

7. A turbine engine combustor system comprising:

a combustor component; and a substantially tubular flow sleeve having an axial upstream end, an axial downstream end, an outer peripheral surface and an inner passage, the downstream end being substantially tubular without a flange extending radially outwardly from the outer peripheral surface, the downstream end of the flow sleeve being connected to the combustor component and extending cantilevered therefrom to the upstream end, whereby the upstream end of the flow sleeve is not attached to another structure, the flow sleeve including at least one thermal relief slot, wherein the slot extends from the axial downstream end and toward the axial upstream end, wherein the thermal relief slots extend no more than about half the axial length of the flow sleeve.

8. The system of claim 7 wherein the downstream end of the flow sleeve is connected to the combustor component by a plurality of fasteners.

9. The system of claim 8 wherein the fasteners are bolts.

10. The system of claim 8 wherein the flow sleeve has a longitudinal axis, and wherein the fasteners extend substantially radially to the longitudinal axis.

11. The system of claim 8 wherein the flow sleeve and the combustor component are indirectly connected in at least one location, and further including a spacer extending between and operatively engaging the flow sleeve and the combustor component, wherein one of the fasteners extends through the spacer.

12. The system of claim 11 wherein the flow sleeve has a longitudinal axis, and wherein the fastener extending through the spacer extends non-radially to the longitudinal axis.

13. A turbine engine combustor system comprising:

a first combustor component having a plurality of passages therein;

a substantially tubular flow sleeve having an axial upstream end, an axial downstream end, an outer peripheral surface and an inner passage, the flow sleeve including a plurality of passages proximate the downstream end, wherein the passages in the flow sleeve are substantially aligned with the passages in the first combustor component, the downstream end being substantially tubular without a flange extending radially outwardly from the outer peripheral surface, the flow sleeve including at least one thermal relief slot, wherein the slot extends from the axial downstream end and toward the axial upstream end; and a plurality of fasteners, each of the fasteners extending through a respective one of the passages in the flow sleeve and into engagement an aligned passage of the first combustor component so as to connect the downstream end of the flow sleeve to the first combustor component, the outer peripheral surface of the flow sleeve and the combustor component being in direct contact circumferentially about at least a portion of the outer peripheral surface of the flow sleeve, wherein the flow sleeve extends cantilevered therefrom to the upstream end, whereby the upstream end of the flow sleeve is not attached to another structure, the flow sleeve having a longitudinal axis, the fasteners extending substantially radially to the longitudinal axis.

14. The system of claim 13 wherein at least one of the passages in the flow sleeve is offset at least radially inwardly from the other passages.

15. The system of claim 14 wherein the flow sleeve and the first combustor component are indirectly connected at the at least one offset passage in the flow sleeve, and further including a second combustor component operatively engaging the first combustor component and a spacer extending between and operatively engaging the flow sleeve proximate the offset passage and the second combustor component such that a respective one of the fasteners extends through the spacer and into engagement with the second combustor component.

16. The system of claim 15 wherein the second combustor component is a joint bolt.

17. The system of claim 15 wherein the flow sleeve has a longitudinal axis, and wherein the fastener extending through the spacer is non-radial to the longitudinal axis.

* * * * *